United States Patent [19]

Leventhal et al.

[11] Patent Number: 5,027,468

[45] Date of Patent: Jul. 2, 1991

[54] REPLACEABLE CLEANING IMPLEMENT AND PROCESS FOR MAKING SAME

[76] Inventors: Sheldon Leventhal, 30500 Brookwood Dr., Pepper Pike, Ohio 44124; Henry R. Patricy, 2640 Lost Nation Rd., Willoughby, Ohio 44094

[21] Appl. No.: 399,896

[22] Filed: Aug. 29, 1989

[51] Int. Cl.[5] ..... A47L 13/20

[52] U.S. Cl. ..... 15/229.001; 15/229.3; 15/229.7

[58] Field of Search ..... 15/228, 229.1, 226, 15/229.2, 229.3, 229.4, 229.5, 229.6, 229.7, 229.8; 57/210

[56] References Cited

U.S. PATENT DOCUMENTS

| | | | |
|---|---|---|---|
| 2,313,058 | 3/1943 | Francis, Jr. | 57/210 X |
| 2,388,096 | 10/1945 | Trindl | 15/229.1 |
| 2,409,666 | 10/1946 | Briggs | 57/210 X |
| 2,600,143 | 6/1952 | Vaughn | 15/229.1 X |
| 2,825,914 | 3/1958 | Moss | 15/229.1 |
| 3,321,903 | 5/1967 | Tanzer | 15/229.1 X |
| 3,827,099 | 8/1974 | Allaire et al. | |
| 4,097,952 | 7/1978 | Lindstrom | |
| 4,114,224 | 9/1978 | Disko | 15/229.1 |
| 4,115,895 | 9/1978 | Ballew | |
| 4,225,442 | 9/1980 | Tremblay et al. | 57/210 X |
| 4,264,545 | 4/1981 | Alibeckoff | |
| 4,313,774 | 2/1982 | Arthur | |
| 4,523,347 | 6/1985 | Tames | 15/228 X |
| 4,547,426 | 10/1985 | Montle | 57/210 X |
| 4,717,616 | 6/1988 | Harmon et al. | 15/229.1 |

FOREIGN PATENT DOCUMENTS 201363 8/1923 United Kingdom .

*Primary Examiner*—Frankie L. Stinson

*Attorney, Agent, or Firm*—Watts, Hoffmann, Fisher & Heinke Co.

[57] ABSTRACT

The instant cleaning implement is of disposable construction for use with a mop frame or the like. It comprises a plurality of flexible absorbent elements joined together along an astricting connective alignment that is intermediate to the edges of said elements, each of which has a core portion comprising polymeric material. The implement has a pliant cleaning section comprising a group of rows of those portions of the absorbent elements that project from one side of the alignment in a configuration which is generally fan-like in vertical cross section. The process for making the implement comprises stacking the absorbent elements, then joining them along an astricting connective alignment which can be symmetric or asymmetric with respect to the resulting stack.

15 Claims, 6 Drawing Sheets

REPLACEABLE CLEANING IMPLEMENT AND PROCESS FOR MAKING SAME

TECHNICAL FIELD

This invention relates to a cleaning implement for use with a mop frame or the like and to a process for making the same. More particularly it relates to such cleaning implement that can be made largely if not entirely from sorptive synthetic materials, is disposable, and one that can be mass produced by joining and cutting laminae comprising such materials.

BACKGROUND ART

Heretofore strips, rectangular in cross section, of synthetic materials have been made for use as mop heads. Thus, strips of regenerated cellulose in which core yarns are embedded have been proposed. Regenerated cellulose sheets bound together with synthetic resin and cut into strips also have been proposed. Fiber strips of rectangular cross section for mop heads have been suggested, as have strips of wash leather, sponge rubber, and fabric.

The instant invention provides a cleaning implement that is very effective for wiping and washing, particularly one that is useful as a disposable refill for a holder, and ways to make it in a highly efficient manner. The implement itself can be removed from and replaced in typically a conventional clamp-type frame or other holder, e.g., for washing out or disposal. It is very light, it can be made readily in broad widths, and some preferred embodiments can be produced in multiples, e.g. twins, triplets, and quadruplets.

BROAD STATEMENT OF THE INVENTION

The instant implement comprises a plurality of flexible, sorptive layers as the absorbent elements joined together in an astricting connective alignment along an inboard region of the layers to leave a pliant group of projecting layer portions as a cleaning section. Such section projects outwardly with unbound edges in a configuration that is generally fan-like in its vertical cross section. Each layer comprises a core of flexible foamed polymer; the core desirably is covered on at least one side with a flexible porous membrane. In some embodiments least a substantial fraction, i.e., about 25% or more, of the projecting outer edges on at least one side of the assembled layers are slit back towards the inboard region of joining to provide rows of independently bendable tuftlets in a layer.

The instant process comprises stacking the layers, at least a substantial fraction of which can be preslit for tuftlets along their edges on at least one side of the resulting stack; then compressing and joining the stacked layers together along an astricting connective alignment, typically by stitching vertically clear through the stack.

For convenience herein a readily pliant group of outwardly-projecting joined layer portions, often bearing tuftlets at the edges, may be referred to as a "cleaning section"; and a stubbier group of outwardly-projecting joined layer portions, rarely if ever slit at the edges into tuftlets, may be referred to a "gripping part" of the cleaning implement. The shorter-projecting stubby gripping part, e.g. $\frac{3}{8}''$–$\frac{3}{4}''$, will be somewhat stiffer than a longer-projecting cleaning section e.g. 1" or more, although both of these projecting items can be used for cleaning, wiping, squeegeeing etc. in general.

Where the layers of absorbent elements are joined together there is formed a connective alignment, usually substantially straight, that extends continuously or intermittently for substantially the length of the implement. Because the absorbent elements are compressible, the connective alignment, e.g. stitches of nylon thread, tends to draw the assembled layers together along that alignment and hold them there; thus it is described as an "astricting connective alignment," A single straight row of stitches of thread normally will make a very narrow alignment. Adhering or melting together of the layers to connect them can make for a wider alignment, as can broad rivets or much zig-zag or multiple parallel stitching or other conventional connecting means. Frequently the connective alignment will be asymmetric with respect to the width or height of the finished cleaning implement, but it need not always be so.

BEST MODE FOR CARRYING OUT THE INVENTION

Figure 1:
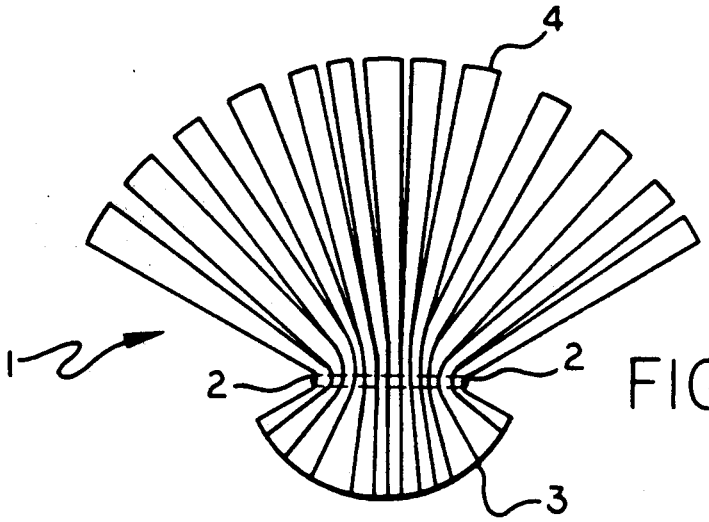
FIG. 1 is an end elevation of a preferred refill mop head of this invention, one made by a preferred process of this invention.
Figure 2:
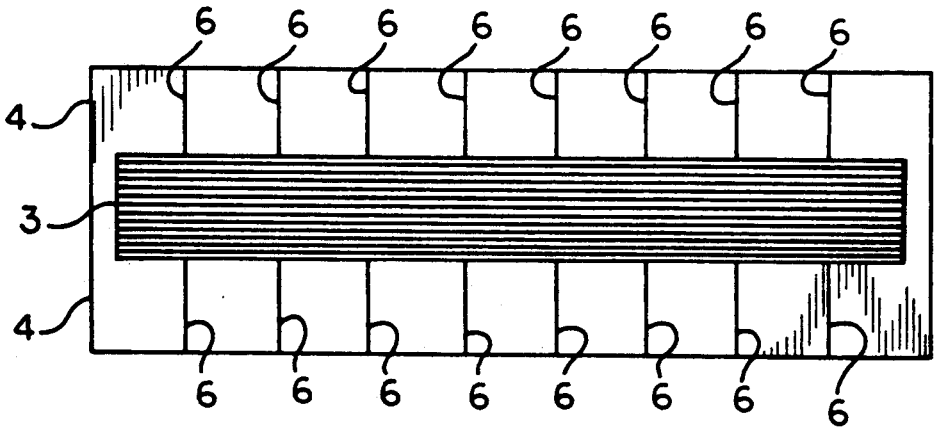
FIG. 2 is a bottom plan view of the mop head of FIG. 1.
Figure 3:
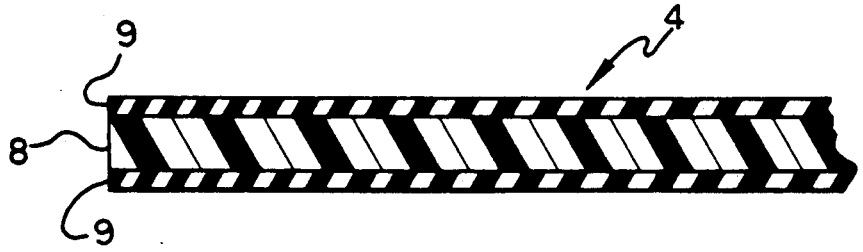
FIG. 3 is a fragmentary end edge view on an enlarged scale of one of the flexible sorptive layers of FIGS. 6 and 9.
Figure 4:
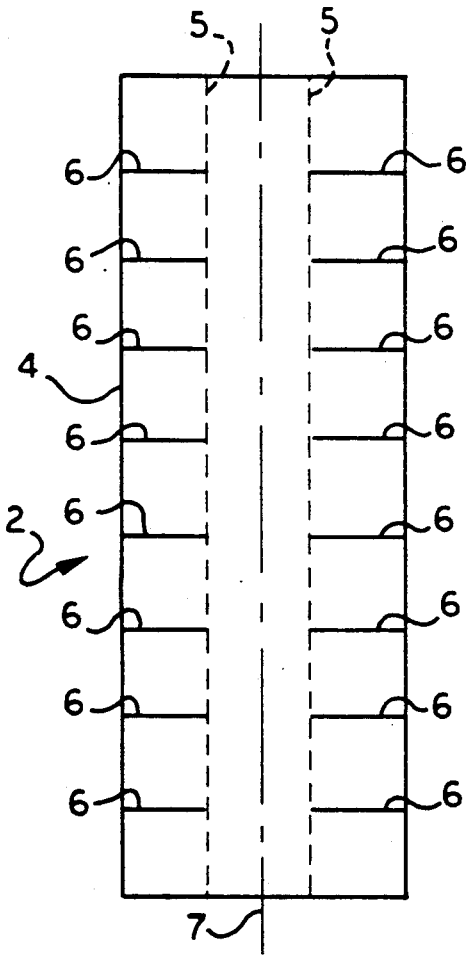
FIG. 4 is a plan view of the top layer of the stack of layers of FIG. 6, from which the mop head of FIG. 1 was made.
Figure 5:
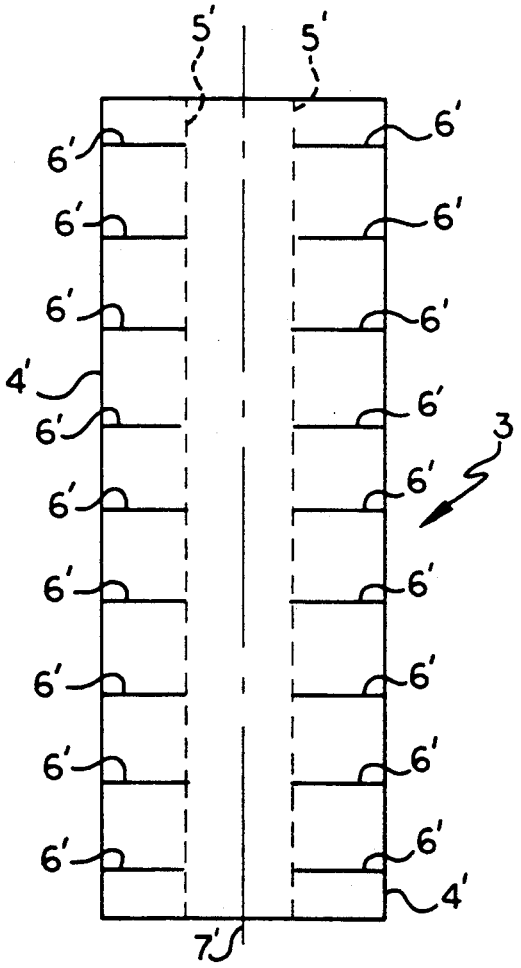
FIG. 5 is a plan view of the layer just below the top one of the stack of FIG. 6.
Figure 6:
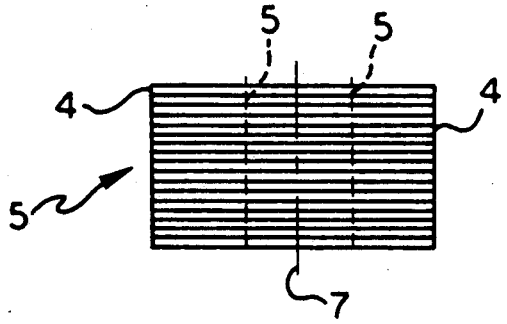
FIG. 6 is an end elevation view of the stack from which the mop head of FIG. 1 was made.

Referring to FIGS. 1–6, the arrow 1 generally indicates the end of the mop head broadly. As shown thirteen outwardly-flaring rows of wiping tuftlets, as at 4, project outwardly and upwardly, and a gripping bundle of rows of stubby tufts, as at 3, corresponding to the rows of tuftlets, projects downwardly. Both are sets of sorptive material extending away from the viewer in a generally fan-like configuration (in end view) as shown in FIG. 1. The rows of tufts 3 and the corresponding rows of tuftlets 4 are joined together by a line of stitches 2 of a heavy nylon thread that runs clear through them for essentially the length of the mop head. Each row of tuftlets 4 and its corresponding row of stubby longitudinal tufts 3 below the stitch line represents one-half of a rectangular layer of an unsevered original stack of layers as shown in FIG. 6. Before any compression a layer is about 0.1 inch thick; its core 8 can best be seen in FIG. 3. It comprises a flexible, foamed polymeric material. Adhering to each side of the core 8 of each layer is a very thin membrane 9 of flexible, porous, regenerated cellulose, as shown in FIG. 3.

This mop head is readily clamped along the length of the line of stitches 2 to a mop-frame at the end of a handle. The flare of the rows of tufts 3 acts to make the clamping very secure for mop use when the clamp is attached securely to the end of a handle. Such tufts 3 project about 0.4 inch from the line of stitches.

In FIG. 2 the slits 6 in the rows of tuftlets 4 reach from the outer edges of a row essentially back to the unseen stitch line that lies beneath the bundle of the rows of stubby tufts 3. The ends of the resulting bundle of tufts 3 are trimmed back just a bit. Each wiping tuftlet 4 is about 1.1 inches long from stitch line to outer edge and about an inch wide; it can bend independently from the tuftlets on either side of it in a row, and it can work somewhat like a finger in a mopping or wiping action. The stitching makes a central region of joining about 1.1 inches thick, and it runs almost the full length of the mop head, about nine inches.

A fragment on edge of an uncompressed layer of sorptive material shown in FIG. 3 is indicated broadly by arrow 4. Core 8, of flexible, open cell polyurethane foam material about 0.1 inch thick is sandwiched between two adhering, very much thinner porous regenerated cellulose membranes 9. Amongst other things, the membranes 9 tend to protect the core 8 from excessive rubbing off, particularly at edges and corners, of tiny crumbs and snagging of the foamed polymer on minor irregularities of mopped surfaces. Bonded-on, the cellulose also can reinforce the core.

In FIG. 4 the top layer of an uncompressed stack of the layers shown in FIG. 6 is used for making a mop head like that of FIG. 1. Such top layer is indicated broadly by arrow 2. Slits 6 divide the layer into a row of tuftlets 4 on each side of the layer. The parallel lines 5, about one inch apart, represent where the nylon thread stitching will go through the stack of FIG. 6. That will define an unsevered inboard region through the stack. The center line 7 is the line along which the resulting compressed, and sewn stack will be severed to make "twin" mop heads.

In place of stitching, one could use other fastening means to join the layers together in the inboard region, typically in two or more parallel vertical planes or completely across the region with an adhesive to make a block-like center. Representative fastening means other than cord or thread include staples, rivets, banding with wire or rod or strap, adhesives, and/or thermal or ultrasonic bonding of one layer to its adjacent layers intermittently or continuously throughout region of joining, i.e., the situs of the astricting connective alignment.

The layer in the stack 5 of FIG. 6 that is just below the top layer 2 shown in FIG. 4 is the layer indicated broadly by arrow 3 in FIG. 5. The layers of the two FIGS. 4 and 5 are alike, except that the edge slits 6' of FIG. 5, thus the resulting rows of tuftlets 4' of this layer, are staggered with respect to the slits 6 of FIG. 4. To make all the tuftlets staggered from row to row, the odd-numbered layers of the stack are slit like those of FIG. 4, the even numbered ones slit like those of FIG. 5. The thirteen layers of FIG. 6 are practically rectangular and congruent, and are stacked evenly (that is, the resulting stack is a rectangular right prism on its side). In some instances it may be desired to make mop heads with rounded corners, or some tuftlets thinner and/or longer than others etc., and the layers of a stack can be altered readily to get these effects. Some of the implements can be made with no tuftlets at all or only on one of a plurality of cleaning sections or only on part of one such sections.

The end elevation view of the uncompressed stack of FIG. 6 indicates such stack generally by arrow 5. This stack will be compressed for sewing all the layers together through the dotted lines 5. The resulting stitching for the length of the mop head gathers and holds the layers together tightly and astrictively along the parallel vertical planes running through the lines 5 and rearwardly for essentially the length of the layers. When the layers are thus joined, the stack is severed in the vertical plane that runs rearwardly through center line 7. Release of compression on the severed stack yields two (or twin) mop heads; the rows of tuftlets 4 and the rows of the shorter gripping tufts 3 then flare as shown in FIG. 1.

Figure 7:
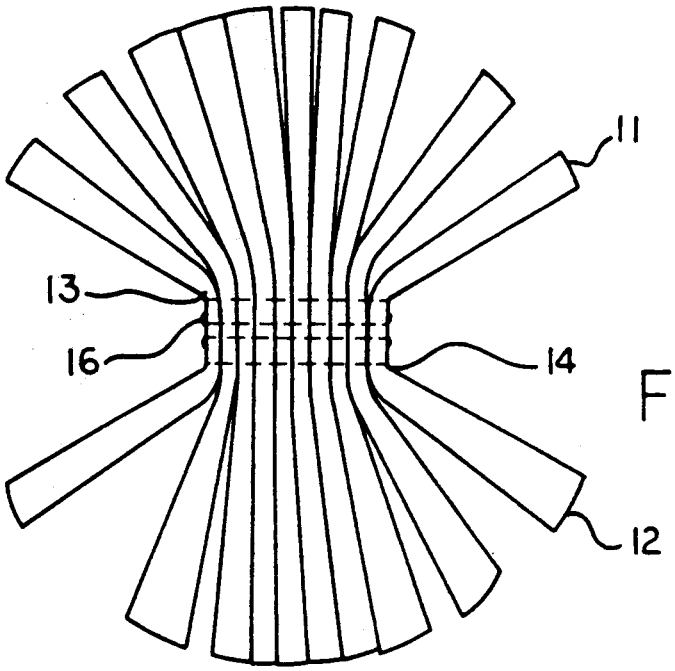
FIG. 7 is an end elevation of an alternative mop head made in accordance with the precepts of this invention.

FIG. 7 shows in end elevation a alternative mop head with substantially central joining of the flexible sorptive layers to have rows of comparatively long slender tuftlets 11 and 12 (3 inches long $\times \frac{1}{4}$ inch wide) projecting from parallel stitch lines 13 and 14 that extend rearwardly for the length of the head.

There is a row of grommetted holes, the nearest one and the only one depicted being item 16, pierced through the zone between the astricting connective alignments (here parallel stitch lines 13 and 14) of the mop head. Through the grommets therein one can place screws or bolts or harness snaps for fastening the head to a crosspiece at the end of a mop handle. Alternatively, the head can be held in a clamp extending across this zone and along its length. The clamp is attached to the end of a mop handle.

Figure 8:
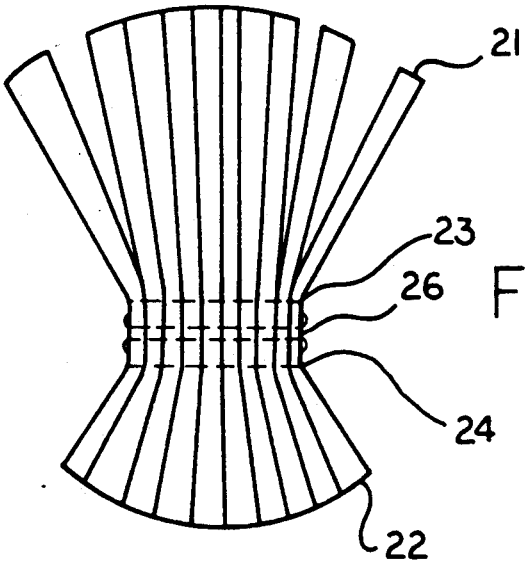
FIG. 8 is an end elevation of another such alternative mop head.

FIG. 8 shows in end elevation a mop head broadly similar to that of FIG. 7 but with the joining region offset from the center a bit to provide a medium stiff bundle of extended rows of tufts 22 on the bottom for squeegee work or the like, and rows of wiping tuftlets 21 flaring out at the top, i.e. a wiping section. It can be attached to a mop handle like the device of FIG. 7. The stitch lines are 23 and 24, and the nearest grommetted hole is 26.

Figure 9:
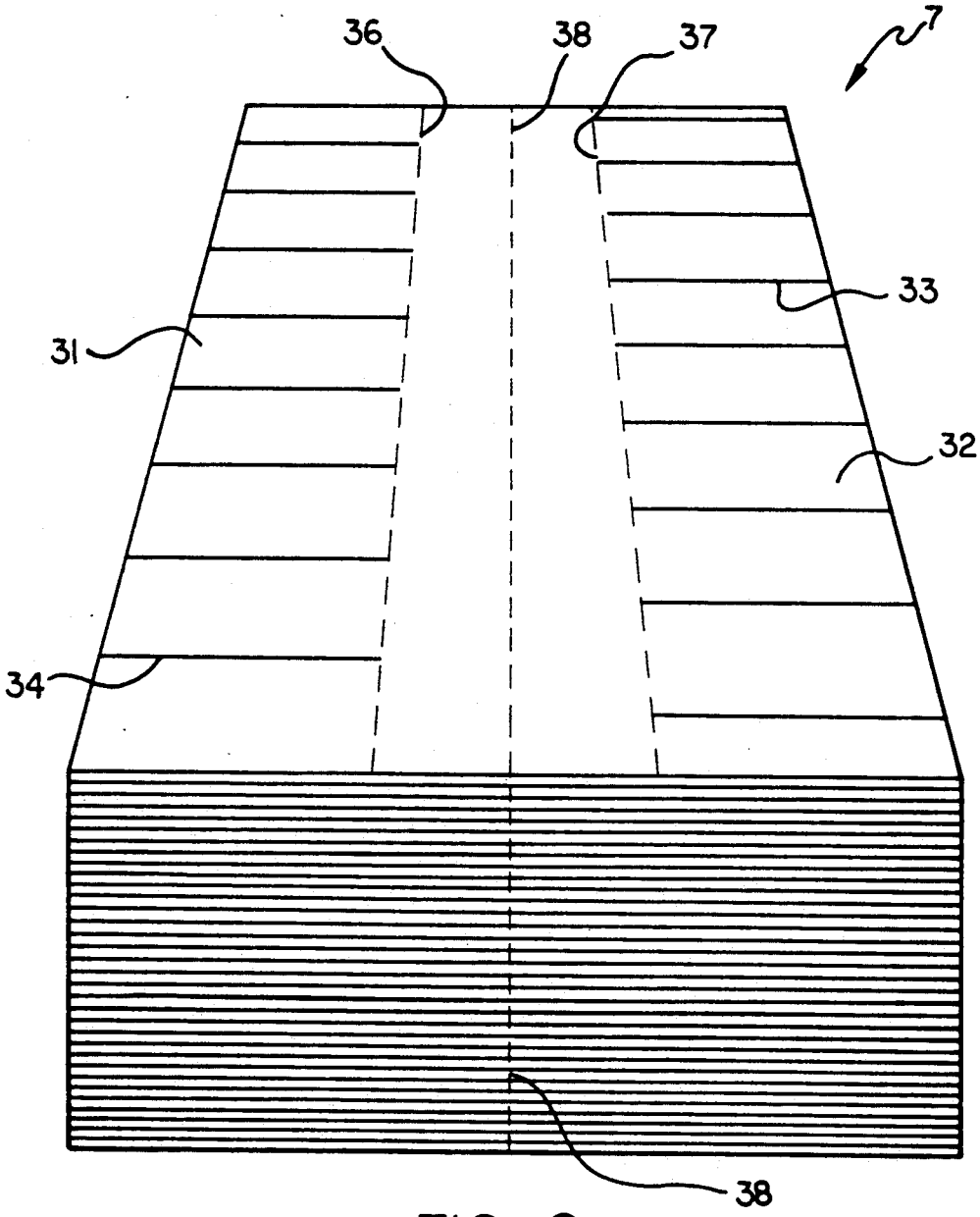
FIG. 9 is a perspective view of die-cut layers of a mop material like that shown in FIG. 3, the layers having been stacked preparatory to making an alternative cleaning implement head.

Reference is made to FIGS. 9–13. FIG. 9 shows a stack of 26 layers of flexible foam material faced with a very thin, flexible, porous, adherent regenerated cellulose membrane on each side. The substance of each layer is like that shown in FIG. 3, but the layers are wider to make longer tuftlets. The layers are die-cut.

The left side of the top layer of the stack is slit to make tuftlets 31 with slits 34 running back to line 36. The right side of the top layer is slit to make tuftlets 32 with slits 33 running back to line 37. The tuftlets on one side are staggered with respect to those of the other. Although not visible in this Figure, the tuftlets on the under layers of the stack are staggered with respect to those in the layers immediately under and over them as well as those on the other side of a layer.

Figure 10:
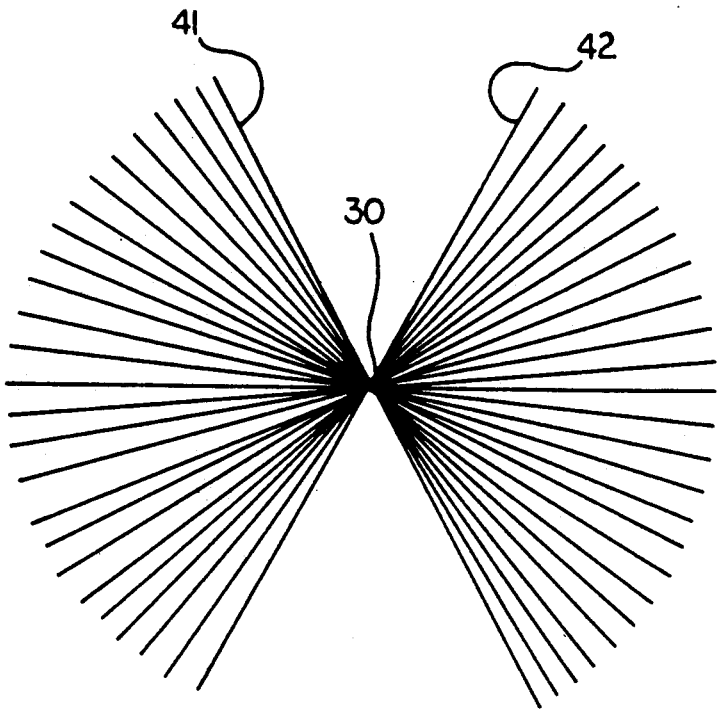
FIGS. 10, 11, 12, and 13 are a series of end view diagrams depicting a process sequence for making such an alternative cleaning implement. In these diagrams each flaring line represents a layer of mop material with a row of tuftlets at its tip ends.

The stack is sewn astrictively through center line 38 as its connective alignment for its full length of the stack using heavy nylon thread, then the layers are folded out to flare into two groups, 41 and 42, as diagrammed in FIG. 10.

Figure 11:
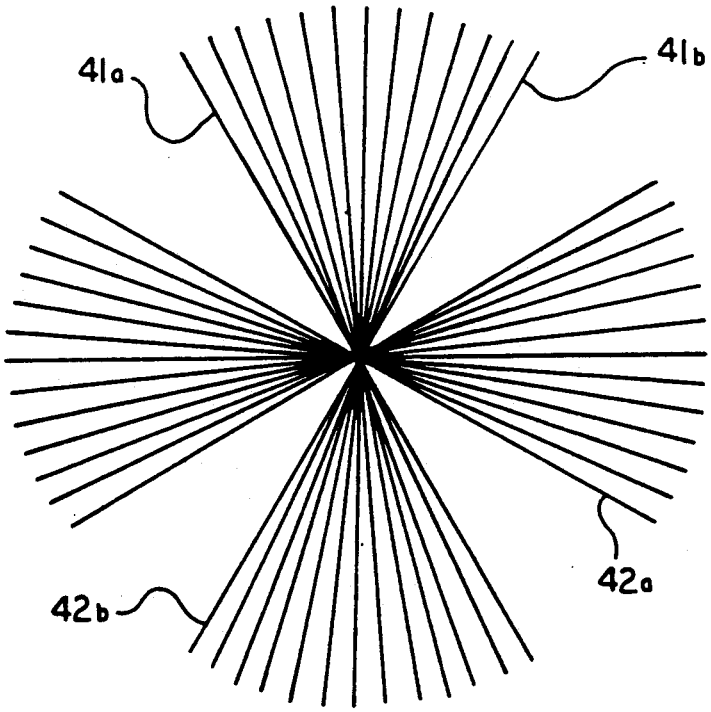
Figure 12:
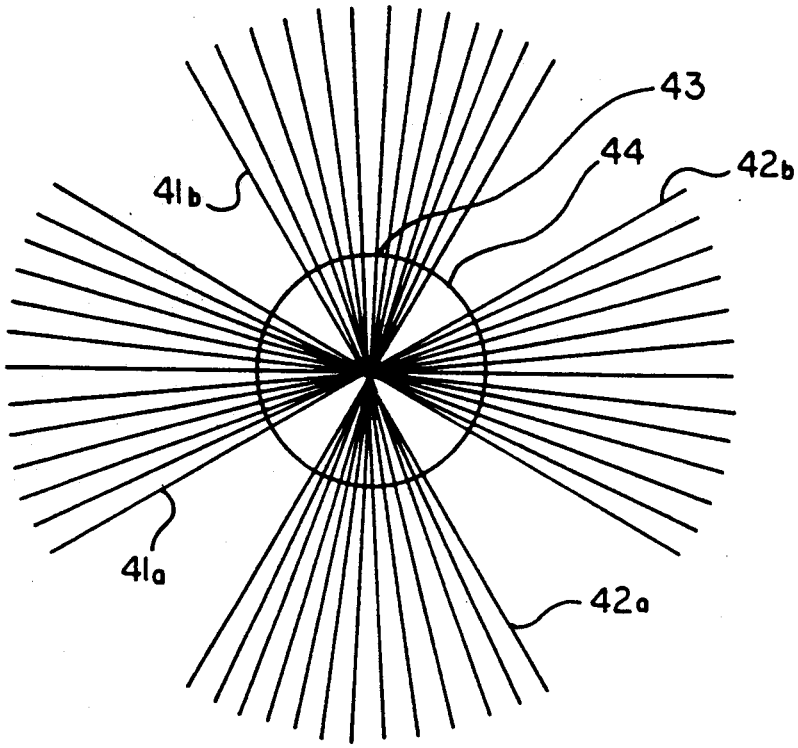
Figure 13:
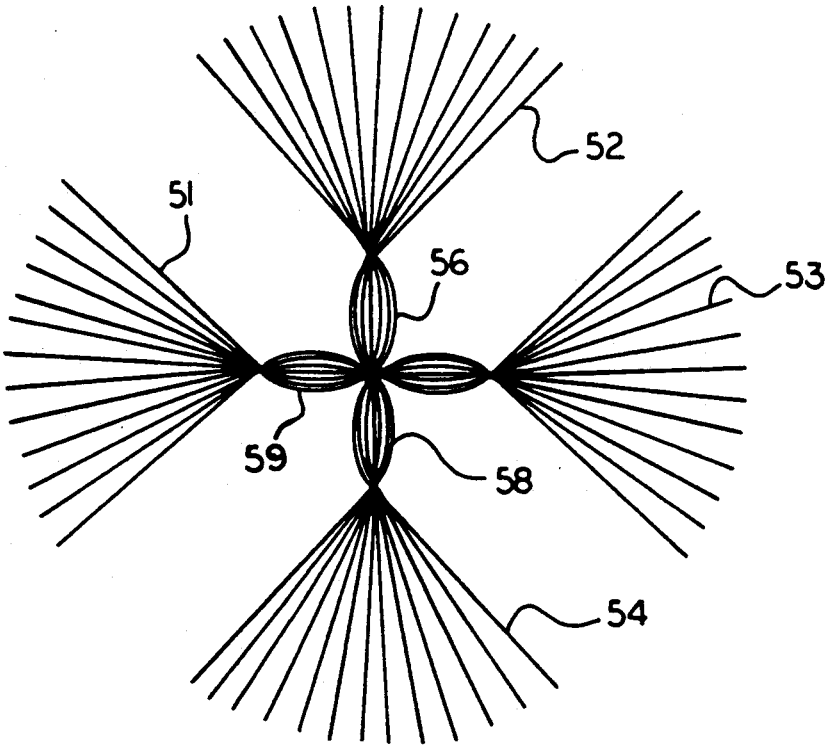

Groups 41 and 42 of FIG. 10 then are divided into groups **41*a* and 41*b* and 42*a* and 42*b* as shown in FIG. 11. The so-divided layers then are sewn together at the perimeter of imaginary circle 44 as diagrammed in FIG. 12. The result is diagrammed in FIG. 13. It is a 4-sided cleaning sponge that can be mounted in a pronged holder, one for example that has prongs extending between the flaring rows of tuftlets 51, 52, 53, and 54, gripping the center bundles 56, 57, 58, and 59, and being capped on the far end with cap means not shown. This cleaning sponge can be used as a stationary one, or it can be rotated with driving means such as an electric motor, a water turbine, or a belt drive. Alternatively it can be severed lengthwise through the centers of bundles 56, 57, 58 and 59 into four mop heads, each of which is broadly similar to that of FIG. 1**.

Other flexible polymeric foams such as flexible synthetic or natural rubber, polyolefin, polyurea and like foams can be used, but flexible polyurethane is preferred. Preferred bubble size is tiny, e.g., 0.01–0.05 inch, but can be larger and still be effective. The membrane can be, instead of a porous sheet of regenerated cellulose, a very light openly-woven or nonwoven fabric, e.g., a cellulosic material or one made of filaments comprising polyacrylamide, polyester, or polyamide or their mixtures. Bonding can be effected with adhesives or, in some cases, with heat or simply by the interaction of a nascent creaming foaming polymer surface with that of the contacting thin porous flexible membrane.

Many other modifications and variations of the invention will be apparent to those skilled in the art in the light of the foregoing disclosure and drawings. Therefore, it is to be understood that, within the scope of the appended claims, the invention can be practiced otherwise than has specifically been shown and described.

We claim:

1. A cleaning implement of a disposable construction comprising:

a plurality of stacked-up and essentially flat, compressible absorbent elements that are substantially rectangular in plan and are joined together astrictively by a connective alignment, each absorbent element having a core comprising flexible, foamed polymeric material, said connective alignment extending substantially the length of said stacked-up absorbent elements between the long edges thereof, said connective alignment fixing a plaint group of absorbent elements in a plurality of rows with their long edges projecting as a cleaning section in a generally fan-like configuration when viewed in vertical cross section.

2. The implement of claim 1 wherein at least a portion of the rows are subdivided along their long edges into tuftlets.

3. The implement of claim 2 wherein the tuftlets are staggered from row to row.

4. The implement of claim 1 wherein the portions of the absorbent elements that project from one side of said connective alignment constitute as a group a cleaning section with a generally fan-like configuration when viewed in vertical elevation, and the portions of the absorbent elements that extend from the opposite side of said connective alignment constitute as a group a gripping section of the implement, said gripping section being less pliant than said cleaning section.

5. The implement of claim 4 wherein there are a plurality of cleaning sections and at least one gripping section therebetween.

6. The implement of claim 5 wherein all the cleaning sections do not extend outwardly substantially the same distance from a connective alignment.

7. The implement of claim 5 wherein all the cleaning sections extend outwardly substantially the same distance from a connective alignment.

8. The implement of claim 4, wherein at least a portion of the rows are subdivided along their long edges into tuftlets which are staggered from row to row, and each side of a core has a flexible porous regenerated cellulose membrane bonded thereto, the cores comprising polyurethane.

9. The implement of claim 8 wherein the connective alignment is at least one line of stitches.

10. The implement of claim 9 wherein the connective alignment is a plurality of lines of stitches.

11. The implement of claim 1 wherein the cores of the absorbent elements are covered on at least one side with a flexible porous membrane.

12. The implement of claim 11 wherein each membrane is bonded to a core, and the core is an open cell thermosetting polymer.

13. A cleaning implement of a disposable construction the implement comprising a plurality of substantially rectangular flexible, absorbent elements in a longitudinal array, each absorbent element comprising a core portion of flexible foamed polymeric material to at least one side of which is bonded a flexible porous membrane, the absorbent elements being joined together along an astricting connective alignment of stitches that is substantially nearer to one long edge of an absorbing element than the other for dividing the connected absorbing elements into a stubby gripping part that flares out from the connective alignment and a pliant cleaning section opposite thereto that is in a configuration which is generally fan-like in vertical cross section, the projecting edge of each absorbing element of the cleaning section being slit for providing a row of individual tuftlets, each of which is bendable independently of the others in its row, the tuftlets being staggered from row to row.

14. The implement of claim 13 wherein each membrane is bonded to a core, the core is an open cell thermosetting polymer, and the stitches are nylon.

15. The implement of claim 13 wherein each side of a core has a regenerated cellulose membrane bonded thereto, and the core comprises polyurethane.

* * * * *